US011820548B2

(12) United States Patent
Perdue

(10) Patent No.: US 11,820,548 B2
(45) Date of Patent: Nov. 21, 2023

(54) MULTI-COMPARTMENT BOTTLE SYSTEM

(71) Applicant: David G. Perdue, Plymouth, MN (US)

(72) Inventor: David G. Perdue, Plymouth, MN (US)

( * ) Notice: Subject to any disclaimer, the term of this patent is extended or adjusted under 35 U.S.C. 154(b) by 0 days.

(21) Appl. No.: 17/987,656

(22) Filed: Nov. 15, 2022

(65) Prior Publication Data

US 2023/0174262 A1 Jun. 8, 2023

Related U.S. Application Data

(60) Provisional application No. 63/286,678, filed on Dec. 7, 2021.

(51) Int. Cl.

| | |
|---|---|
| ***B65D 1/04*** | (2006.01) |
| ***B65D 47/18*** | (2006.01) |
| ***B65D 47/12*** | (2006.01) |
| ***B65D 51/28*** | (2006.01) |

(52) U.S. Cl.

CPC ..... *B65D 1/04* (2013.01); *B65D 47/121* (2013.01); *B65D 47/122* (2013.01); *B65D 47/18* (2013.01); *B65D 51/2864* (2013.01)

(58) Field of Classification Search

CPC .... B65D 2217/00–04; B65D 11/00–28; B65D 1/04; B65D 47/121; B65D 47/122; B65D 47/18; B65D 51/2864

See application file for complete search history.

(56) References Cited

U.S. PATENT DOCUMENTS

| | | | | |
|---|---|---|---|---|
| 5,881,894 | A | 3/1999 | Gargano | |
| 6,085,919 | A | 7/2000 | Singer | |
| 6,772,910 | B1 * | 8/2004 | Coory | B65D 47/38 222/541.6 |
| 6,959,841 | B2 * | 11/2005 | Vlodek | B65D 51/28 222/525 |
| D576,877 | S | 9/2008 | Alcamo et al. | |
| 9,090,381 | B2 | 7/2015 | Yang | |
| 9,359,183 | B2 | 6/2016 | Henderson | |
| 10,899,528 | B2 | 1/2021 | Merjuste et al. | |
| 2005/0029130 | A1 * | 2/2005 | Spector | B65D 51/2828 206/219 |
| 2007/0023300 | A1 * | 2/2007 | Spector | B05B 11/0081 206/219 |
| 2009/0122524 | A1 | 5/2009 | Yang | |
| 2012/0305519 | A1 * | 12/2012 | Lee | B65D 51/002 215/316 |
| 2014/0144794 | A1 * | 5/2014 | Eyrard | A61J 1/2093 206/219 |
| 2014/0144864 | A1 * | 5/2014 | Lee | B65D 51/2864 215/6 |
| 2015/0203254 | A1 * | 7/2015 | Lee | B65D 41/00 215/227 |
| 2015/0217924 | A1 * | 8/2015 | Cho | B65D 81/3216 206/219 |
| 2015/0239638 | A1 * | 8/2015 | Lee | B65D 39/08 206/219 |
| 2015/0266634 | A1 | 9/2015 | Yang | |

(Continued)

*Primary Examiner* — Kareen K Thomas

(74) *Attorney, Agent, or Firm* — Antonio Papageorgiou, Esq.; Lombard Geliebter LLP

(57) ABSTRACT

A bottle stowage means is provided comprised of one or more formed volumes having at least one or more sealable openings accessing inside compartments to store dispensable contents that can be measured for use in vessels.

15 Claims, 19 Drawing Sheets

(56) References Cited

U.S. PATENT DOCUMENTS

| | | | | |
|---|---|---|---|---|
| 2015/0266651 | A1* | 9/2015 | Lee | B65D 51/2864 215/227 |
| 2018/0078455 | A1* | 3/2018 | Defemme | B65D 35/14 |
| 2019/0352065 | A1 | 11/2019 | Pham et al. | |
| 2022/0395626 | A1* | 12/2022 | Kallenberger | A61M 1/77 |

* cited by examiner

MULTI-COMPARTMENT BOTTLE SYSTEM

BACKGROUND OF THE INVENTION

The present application relates generally to containers, such as bottles for storing liquids and more particularly bottle stoppers for such uses.

Before the mid nineteenth century and throughout history, ceramic material was the preferred container material for storage. Earthen materials being easily obtained and shaped were used for a wide variety of single commodity storage means. As the Industrial Revolution matured, glass containers became a vessel of choice. As the twentieth century has unfolded, glass has largely been replaced by plastics for storing a singular commodity in a single container.

Regarding liquor/spirits as a storable commodity, a single liquor packaged in a singular bottle is the preferred method today. The use of barware to combine and mix liquors from separate bottles is synonymous with the nostalgia of drinking. Often persons patronize drinking establishments to engage in the entertainment value of this experience. Often, keeping a multitude of liquor bottles and barware stored at home is an encumbrance many are not willing to engage.

Thus, there remains a need for solid/non-flexible container, such as a liquor bottle, bottle stopper, and/or other stowage means that includes more than one contiguous compartment and other paraphernalia for conveniently storing and mixing contents together in a unified package for safety, efficacy and ease of use.

SUMMARY OF THE INVENTION

A bottle system is provide as described herewith. In one embodiment, a bottle system is provided that includes a structure defining a first volume having an opening at a top thereof; a structure defining a second volume having an opening at a top thereof and a means at the bottom of the second volume for removably attaching the second volume to the top of the first volume and a means for sealing the first volume, wherein the first volume is greater than the second volume; and a fitting for sealing the second volume.

In one embodiment, the bottle system includes a dispenser removably attached to the second volume.

In one embodiment, the dispenser comprises one of a dropper, a pump, a pour spout, and a dropper plug.

In one embodiment, the means for removably attaching the second volume to the first volume comprises a stopper.

In one embodiment, the second volume comprises a skirt surrounding the stopper.

In one embodiment, the skirt encloses the stopper entirely.

In one embodiment, the skirt has a contact area with a flat surface sufficient to prevent the second volume from tipping over when placed on the flat surface.

In one embodiment, the skirt has threads that made with threads on the first volume. In one embodiment, the second volume includes a plurality of hollows, each with an opening therein.

In one embodiment, a first of the plurality of hollows has an opening facing a first direction and a second of the plurality of hollows has an opening facing in a second direction different than the first direction.

In one embodiment, the second volume has a footprint opposite each of each opening in the plurality of hollows, allowing access to only one of the openings in the plurality of hollows at a time.

In one embodiment, bottle system includes a structure defining a third volume, the third volume configured to fit around and removably attach to the first volume.

In one embodiment, the first volume has a bottle neck and wherein the second volume has a bottom end configured to cover the bottle neck.

In one embodiment, the means at the bottom of the second volume for removably attaching the second volume to the top of the first volume comprises a skirt.

In one embodiment, the means at the bottom of the second volume for removably attaching the second volume to the top of the first volume comprises a threaded skirt therewith allowing the second volume to be screwed to the first volume.

In one embodiment, the second volume has a cap with threads therein for sealing the second volume.

Additional aspects of the present invention will be apparent in view of the description which follows.

BRIEF DESCRIPTION OF THE FIGURES

The invention may be more completely understood in consideration of the following detailed description of various embodiments of the invention in connection with the accompanying drawings, in which.

Figure 1:
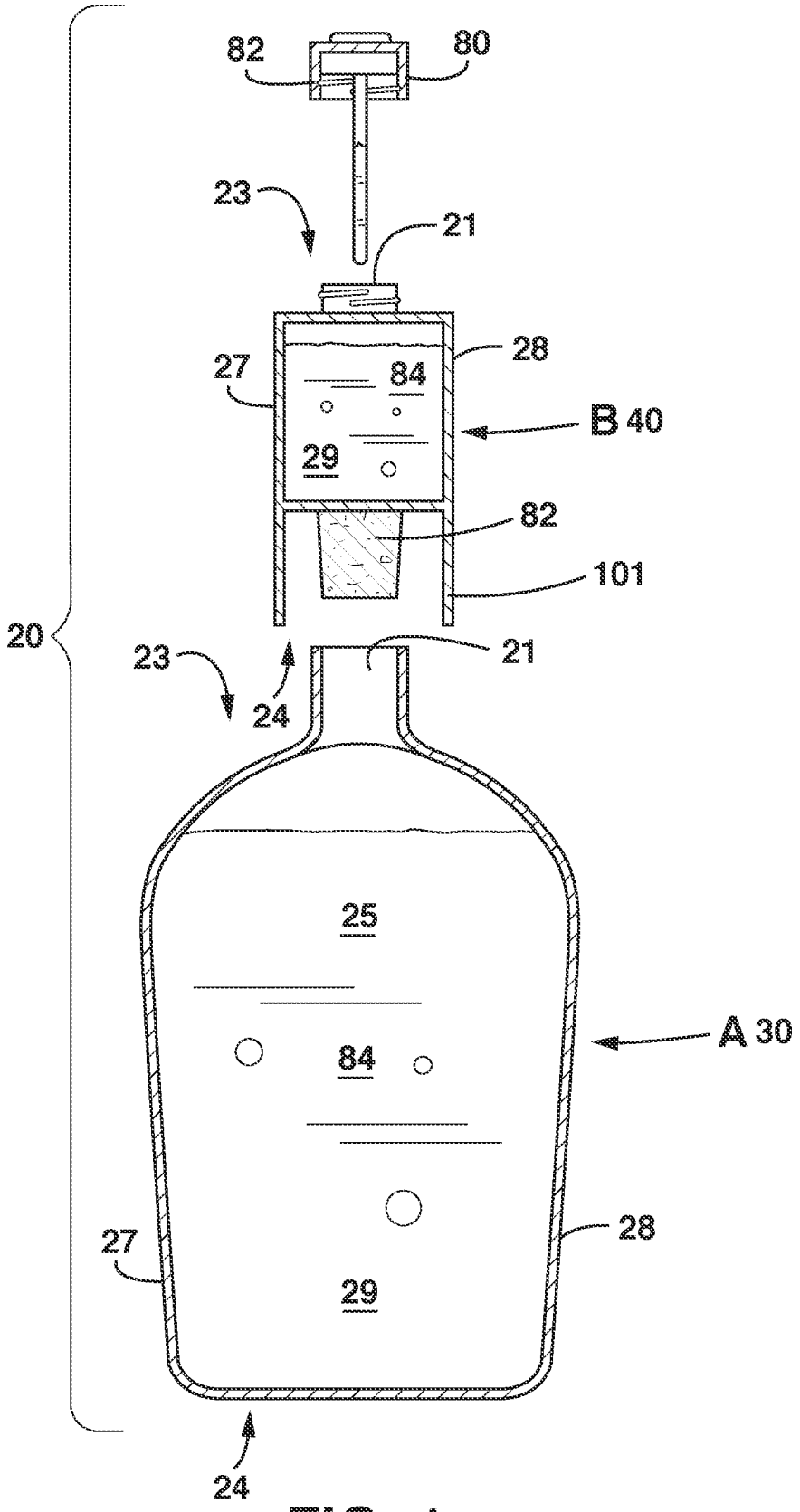
FIG. 1 is an exploded front elevation view sectioned at the center plane of a first embodiment.
Figure 2:
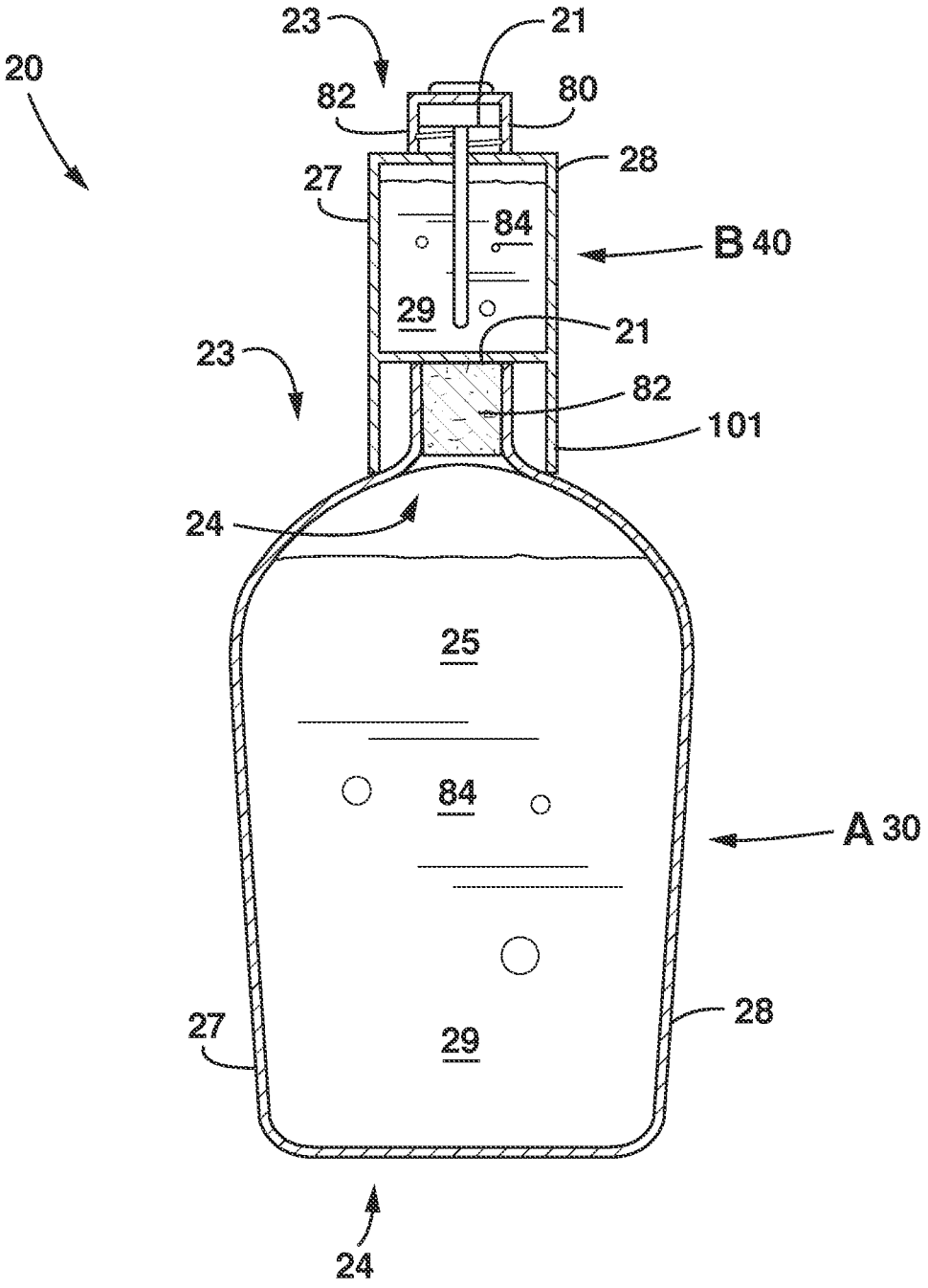
FIG. 2 is a front elevation view sectioned at the center plane of a first embodiment.

While the invention is amenable to various modifications and alternative forms, specifics thereof have been shown by way of example in the drawings and will be described in detail. It should be understood, however, that the intention is not to limit the invention to the particular embodiments described but rather to include all modifications, equivalents, and alternatives.

DETAILED DESCRIPTION OF THE INVENTION

Referring to FIG. 1 through FIG. 20, the bottle/container system 20 (hereinafter referred to generally as a bottle system) is provided for separately storing liquids and for conveniently mixing the liquids stored therein. The system is preferably used for storing liquids and more particularly to liquor/spirits, or any other mixable beverage.

Generally speaking, a bottle system 20 can be manufactured in a multitude of forms as illustrated, as some examples, in the various drawings included herein. The central component of the bottle system 20 are represented by the sealable volume-A 30 and/or one or more of sealable volume-B 40, sealable volume-C 50, sealable volume-D 60, and sealable volume-E 70 which will now be described in detail.

The central component of bottle system 20 represented by sealable volume-A and/or one or more of sealable volume-B 40, sealable volume-C 50, sealable volume-D and sealable volume-E 70, which each have an opening 21 therein which can be of any size and shape. The volumes have a top 23, bottom 24, front 25, back 26, left side 27, and right side 28, therewith forming/defining a volume having a hollow inside 29. The hollow inside 29 can be accessed through opening 21 to store the contents 84. Contents 84, as an example, can be fluids such as spirits, mixers, bitters or a mixture of fluids as well as other ingredients such as cherries, cinnamon sticks, olives to name a few.

The central component of bottle system 20 represented by sealable volume-A and/or one or more of sealable volume-B 40, sealable volume-C 50, sealable volume-D and sealable volume-E 70 have a fitting 82 which can be of any size and form. A fitting 82 can be a top 23, bottom 24, front 25, back 26, left side 27, right side 28 closure for a given volume, as well as a connection to an adjacent volume, as shown. As an example, a fitting 82 (FIG. 1, for example) can be made from cork or synthetic material, and configured as a stopper, screw on threaded cap, clamp on cap or other suitable means to create a seal for opening 21.

The central component of the bottle system 20 represented by the sealable volume-A 30, and/or one or more of sealable volume-B 40, sealable volume-C 50, sealable volume-D 60, sealable volume-E 70, and sealable volume-F 90 can be of any geometric form such as a cylinder, sphere, cube, pyramid or irregular form, to name a few examples. Materials to construct a volume can be glass, plastic, metal, composite materials or other rigid materials suitable for creating a sustainable volume with a hollow inside 29. Bottle system 20 can be made to any size, out of a number of manufacturing processes, such as blow molding, injection molding, metal forming, machining or other manufacturing means, as a few examples.

Figure 6:
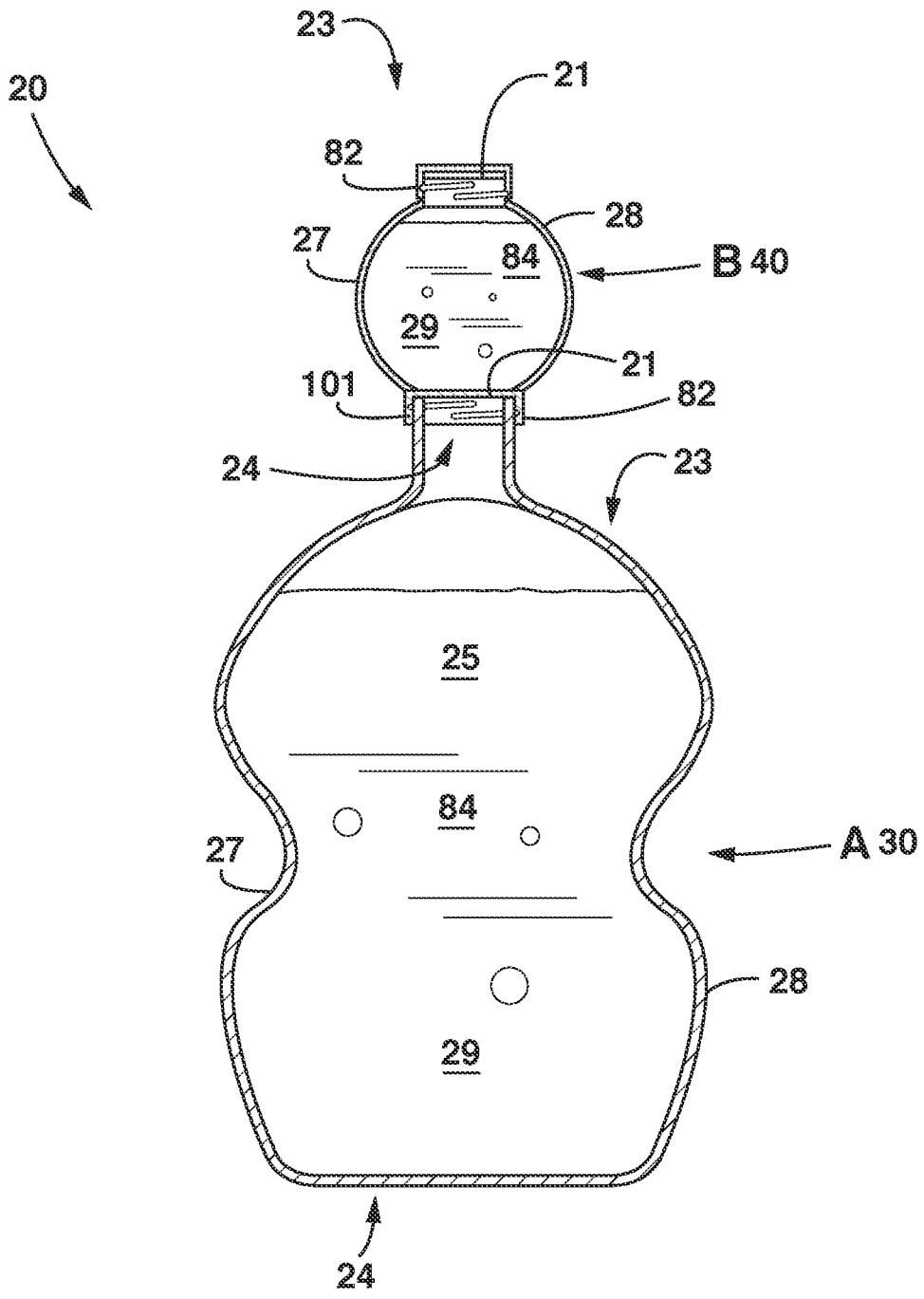
FIG. 6 is a front elevation view sectioned at the center plane of a third embodiment.

Referring to FIG. 1 through FIG. 5, the bottle system 20 can have a dispenser 80 The dispenser 80 can be configured in a multitude of arrangements. As an example, the dispenser 80 may be dropper style and pump style configurations as well as other dispensing means can be present for users to retrieve and dispense contents 84 from the sealable volume-B 40. More particularly, the system 20 includes a first/main volume-A 30 for storing a main liquid, and a second volume-B 40 for storing a second liquid 84. The first volume is preferably greater than the second in a proportion according to a predefined recipe. The second volume preferably includes at the bottom end thereof a means for sealing the first volume with the second volume. As discussed above, this may be with a stopper as shown with a flexible element 82, preferably retained within a skirt 101. The skirt 101 preferably extends downward from the second volume-B 40 so that the flexible element 82 is contained entirely within the skirt 101. Additionally, the skirt 101 may have a footprint/contact area so that the second volume-B 40 does not tip over when placed on a table, for example. As discussed above, the skirt 101 may include threads for screwing/affixing the second volume-B 40 to the first volume-A 30 (FIG. 6). In this embodiment, the dispenser 80 is removably attached to the second volume, as shown, for sealing the second volume content.

Figure 7:
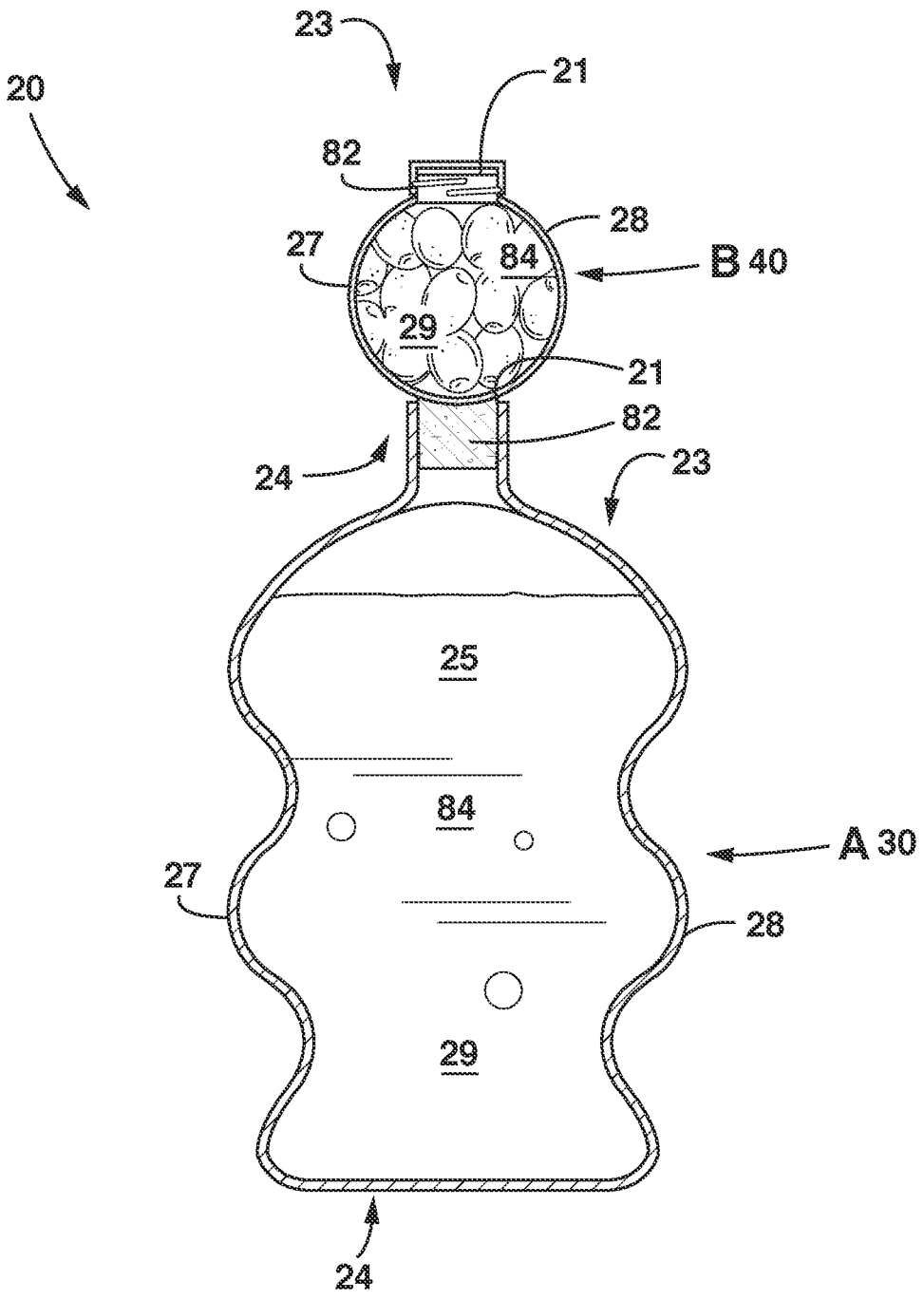
FIG. 7 is a front elevation view sectioned at the center plane of a fourth embodiment.
Figure 8:
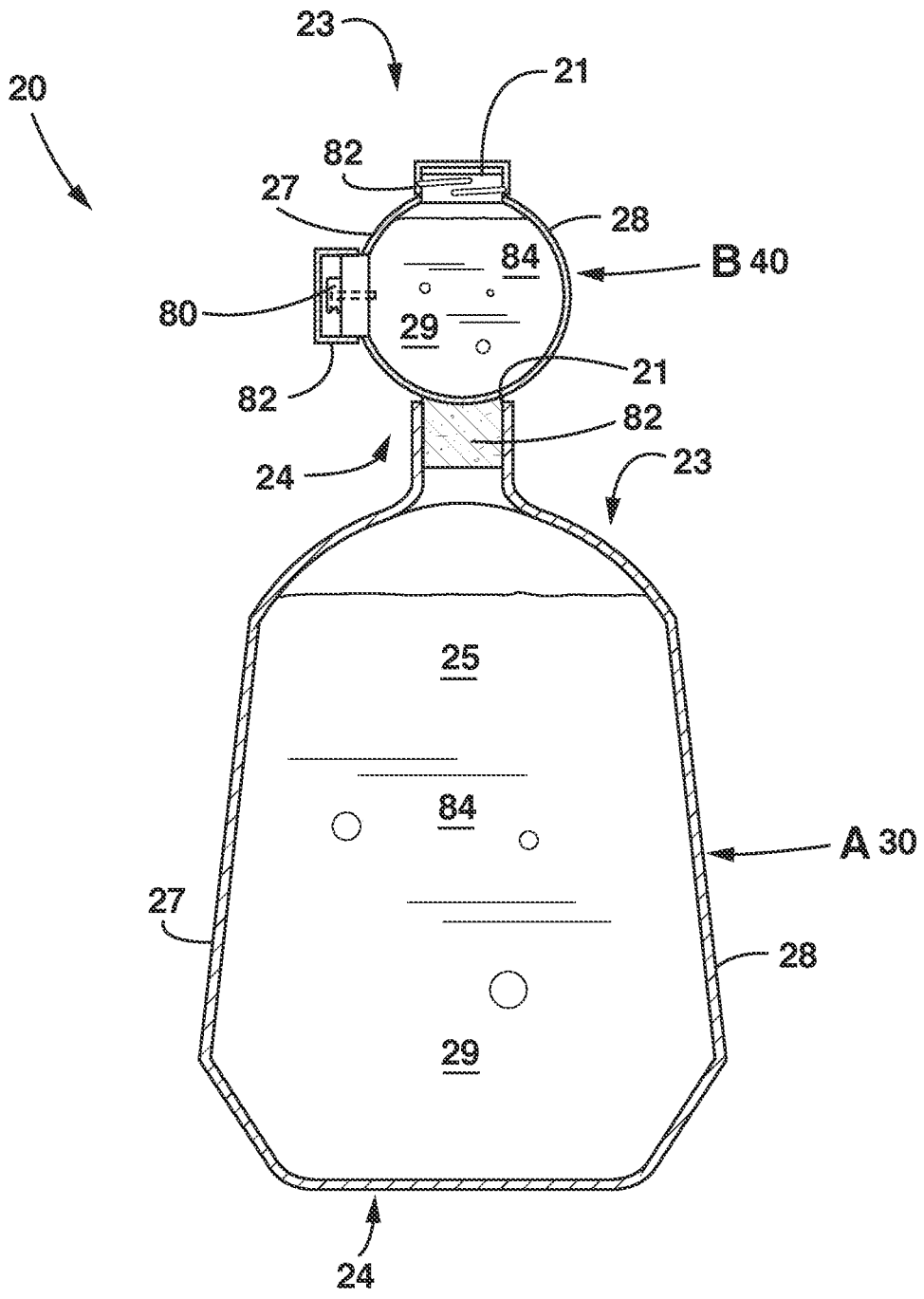
FIG. 8 is a front elevation view sectioned at the center plane of a fifth embodiment.

As is understood, the various volumes may store solid materials, such as olives or cherries, as shown in FIG. 7. In one embodiment, the dispenser 80 may be stored in a compartment separate from the second volume, as shown in FIG. 8. In this instance, the dispenser 80 may have common or complimentary dimensions with opening 21 of the second volume to allow the user to remove content from the second volume with the dispenser 80.

Figure 9:
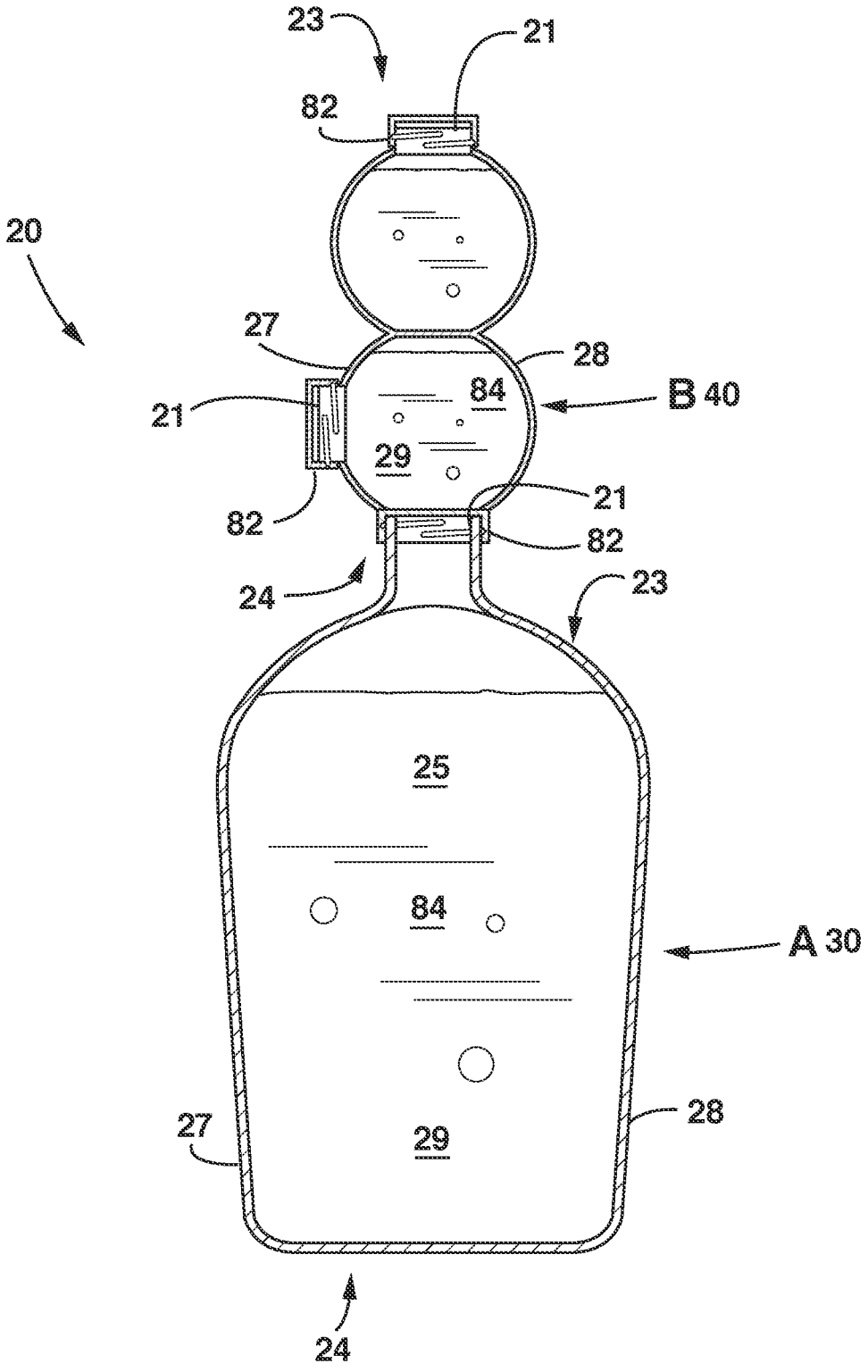
FIG. 9 is a front elevation view sectioned at the center plane of a sixth embodiment.
Figure 10:
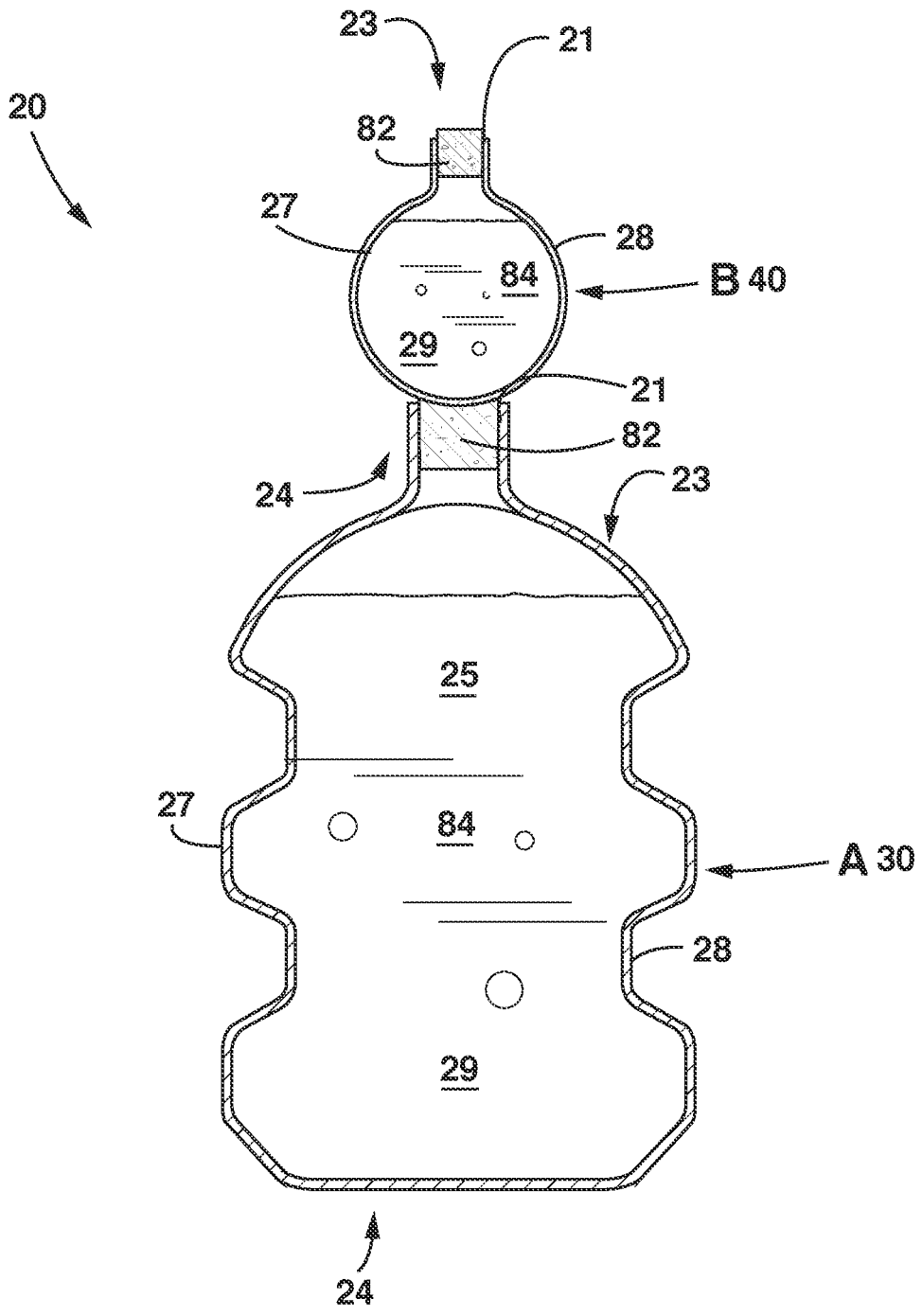
FIG. 10 is a front elevation view sectioned at the center plane of a seventh embodiment.
Figure 11:
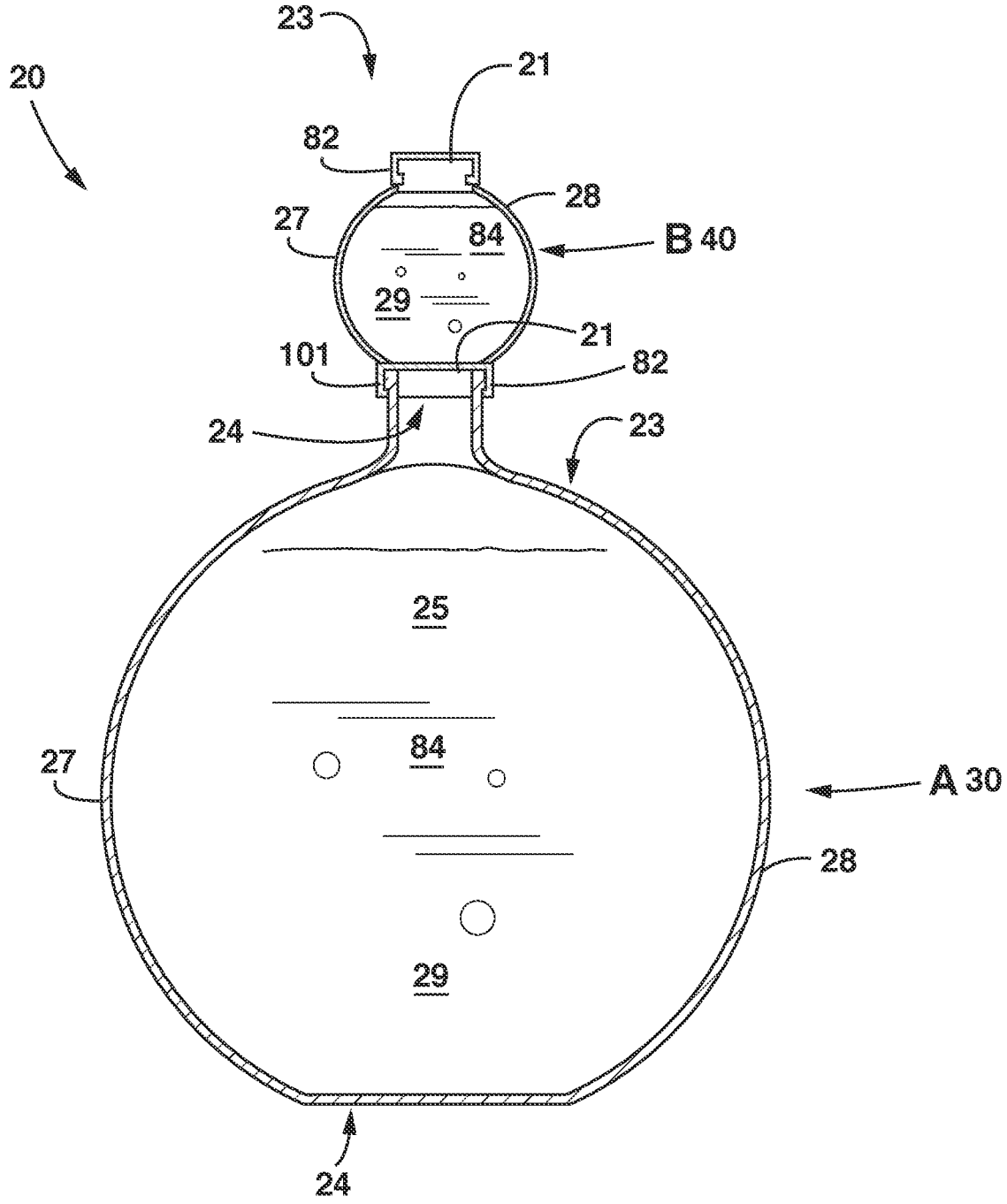
FIG. 11 is a front elevation view sectioned at the center plane of a eighth embodiment.
Figure 12:
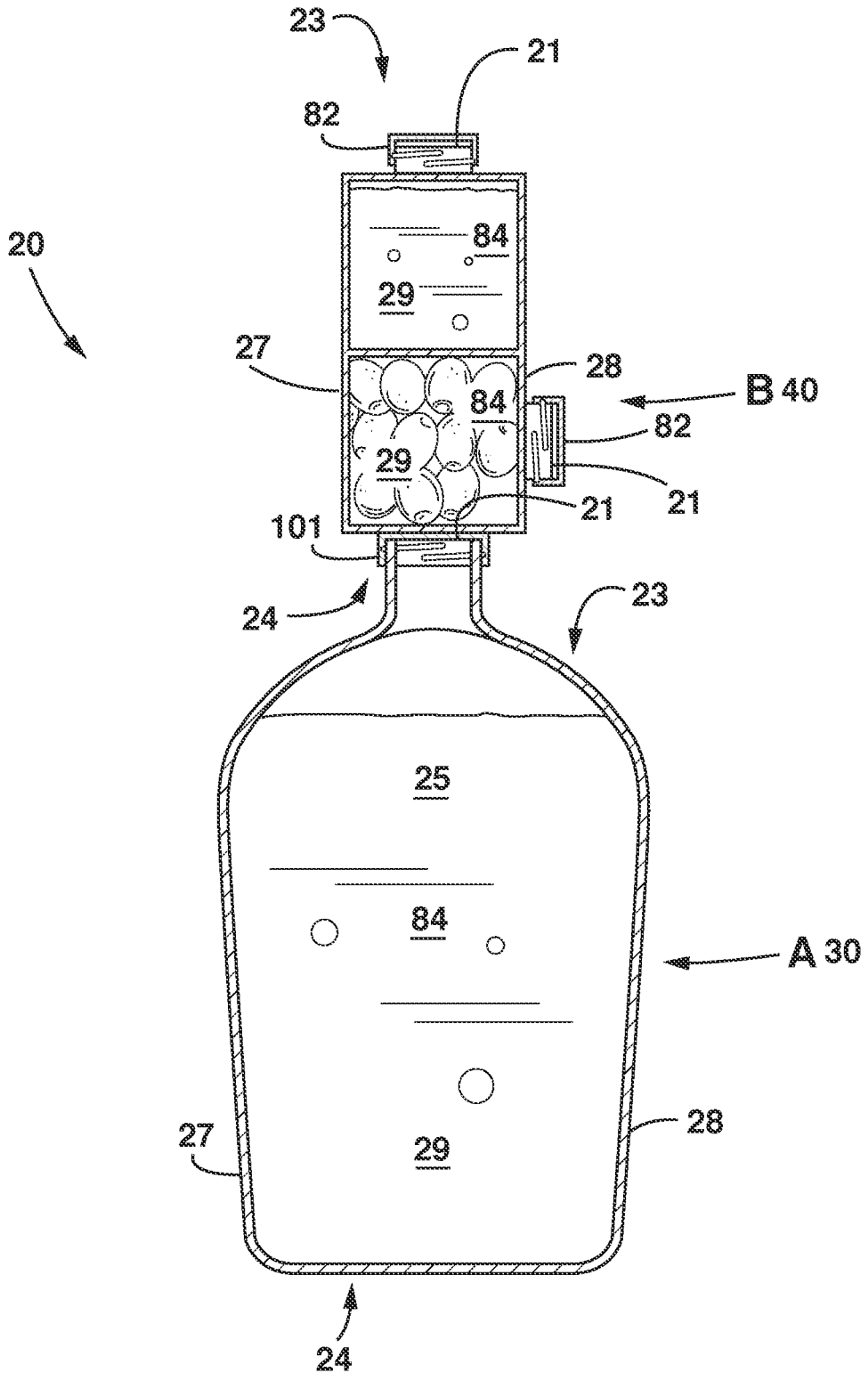
FIG. 12 is a front elevation view sectioned at the center plane of a ninth embodiment.
Figure 13:
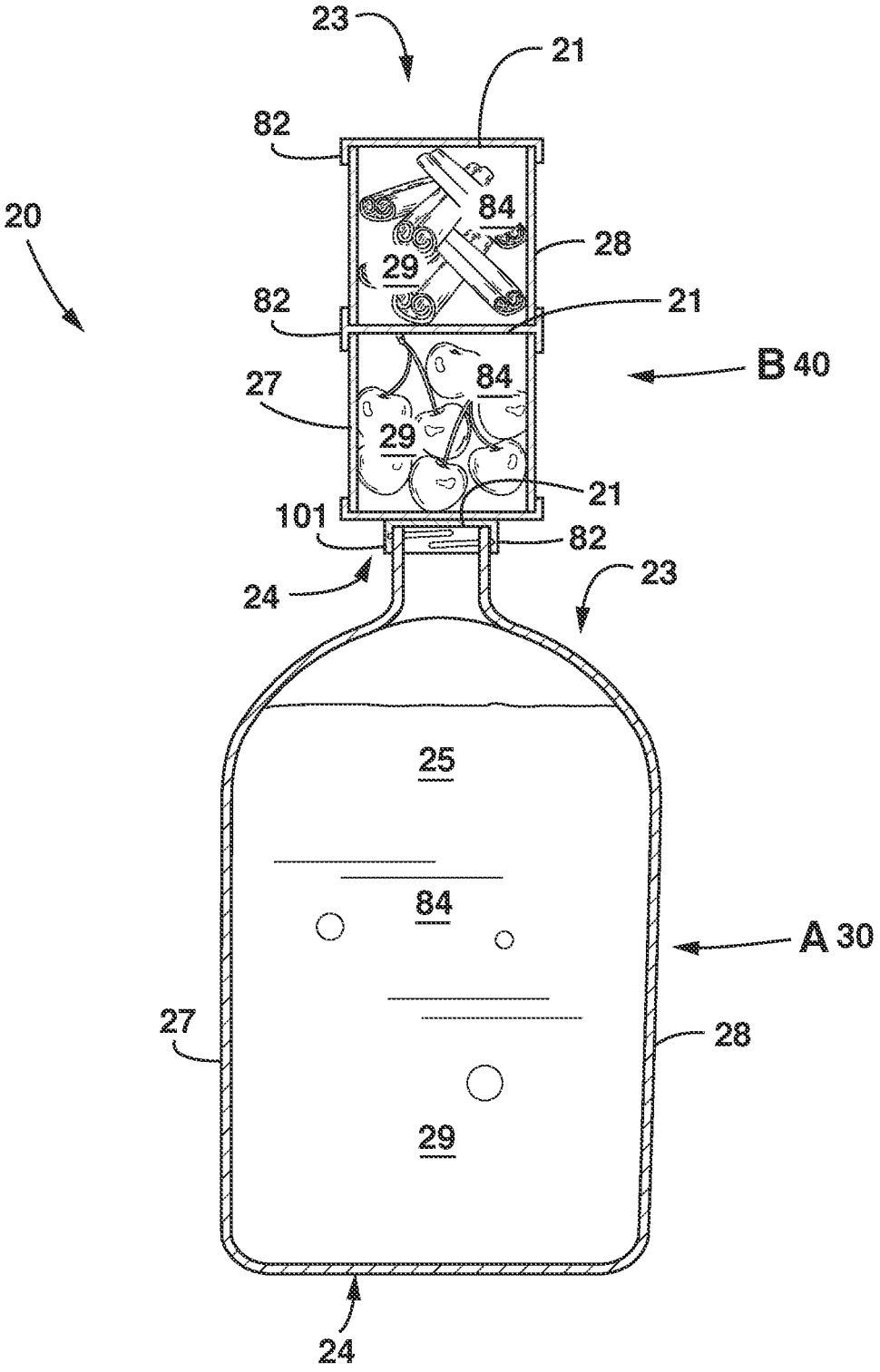
FIG. 13 is a front elevation view sectioned at the center plane of a tenth embodiment.

In one embodiment, the second volume-B 40 provides more than one hollow interior, as shown in FIGS. 9 and 12. In this embodiment, each may include a separate opening 21. Preferably, the openings face in different directions with the opposite side of each of the openings provide a footprint for setting the second volume-B 40 on a surface with only one of the openings 21 facing upward. In this embodiment, the hollows may be coded such that only one code is visible with a given opening facing upward. For example, the interior of a first hollow may be colored in a red color, whereas the interior of a second hollow may be yellow in color, therefore, when the opening for the first volume is facing upward, the color red will be visible and the yellow not visible, reducing possible mixing error.

Figure 3:
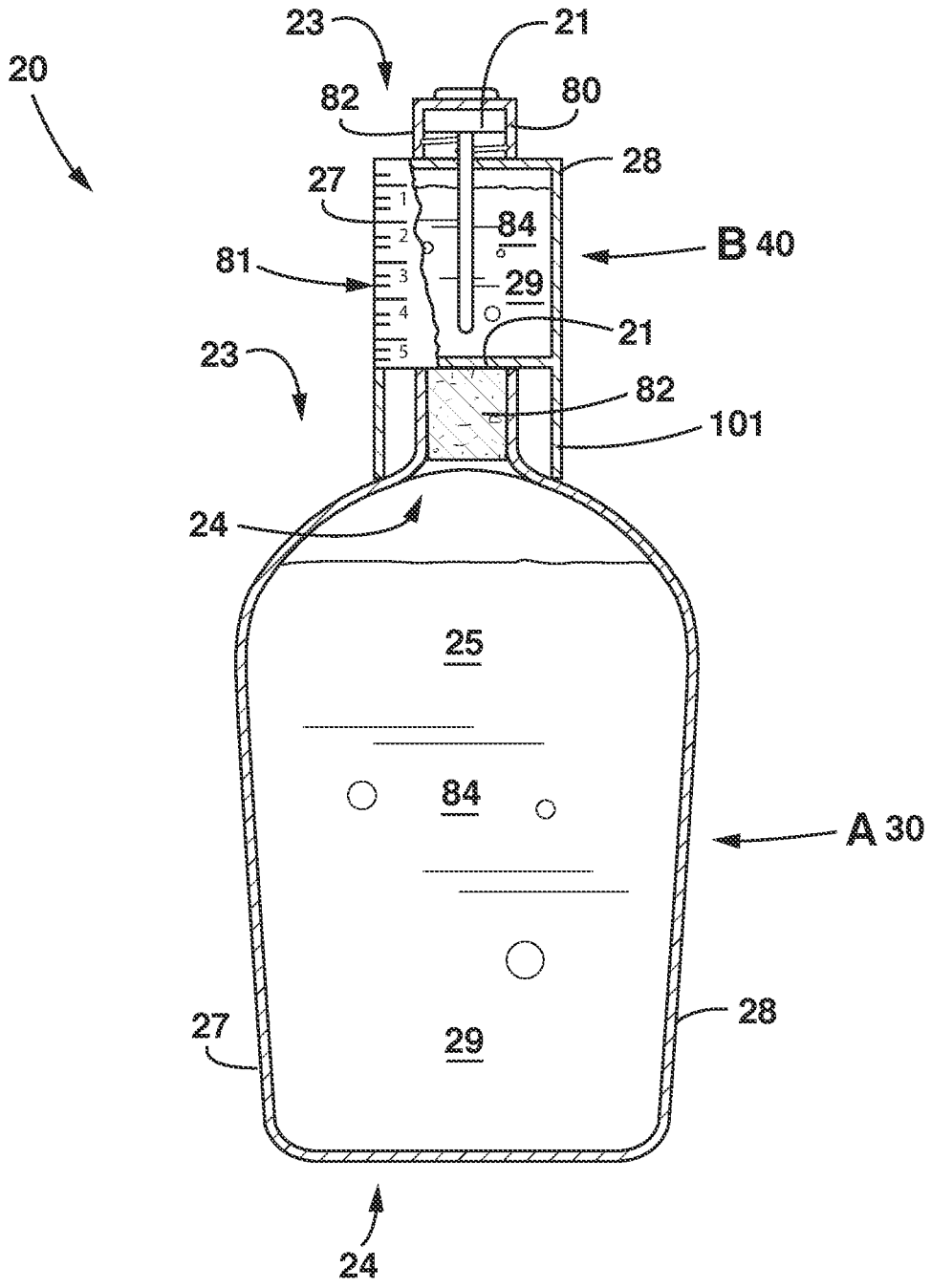
FIG. 3 is a front elevation view sectioned at the center plane with a break away of grade marks incorporated into a first embodiment.
Figure 4:
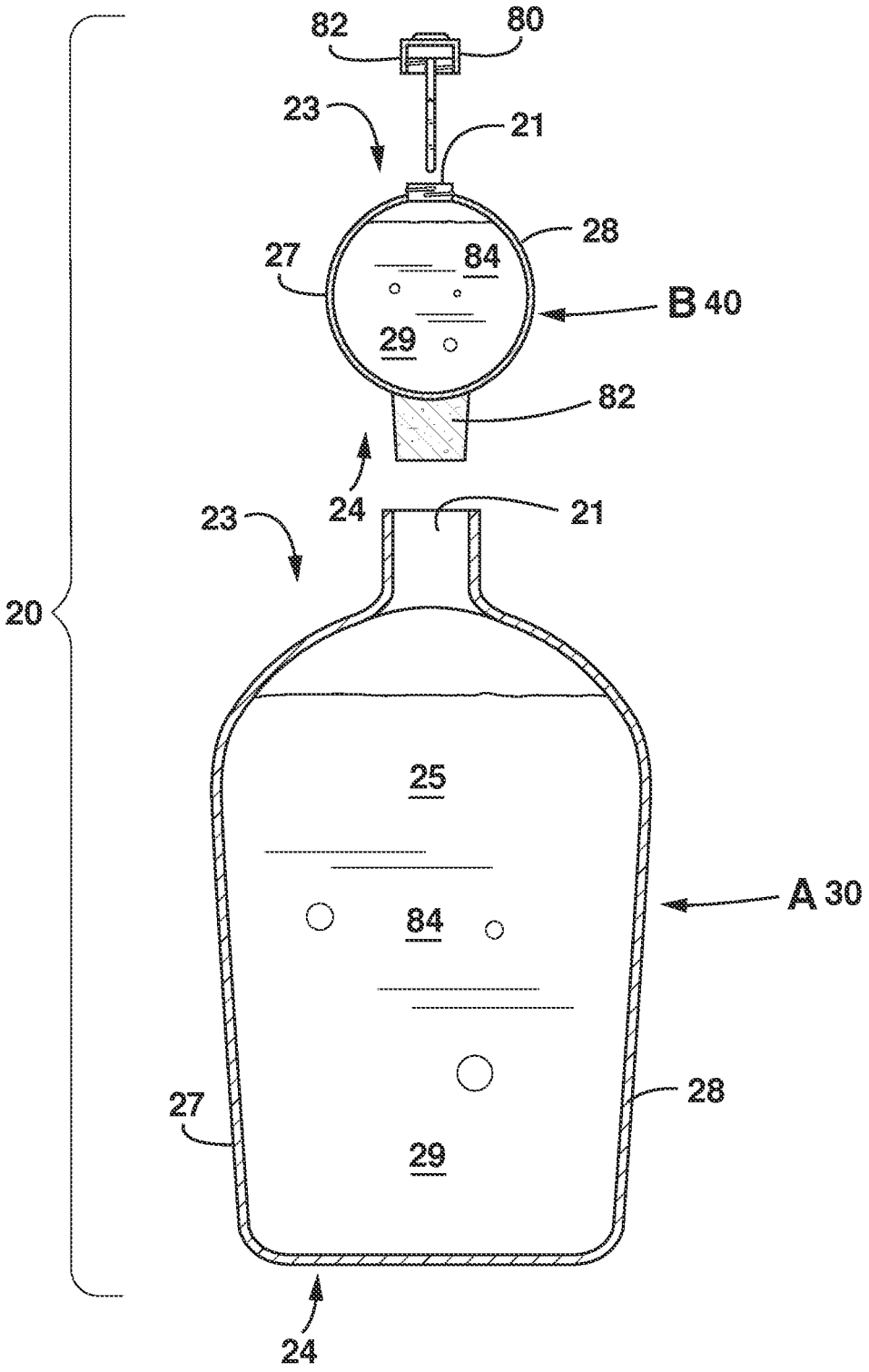
FIG. 4 is an exploded front elevation view sectioned at the center plane of a second embodiment.
Figure 5:
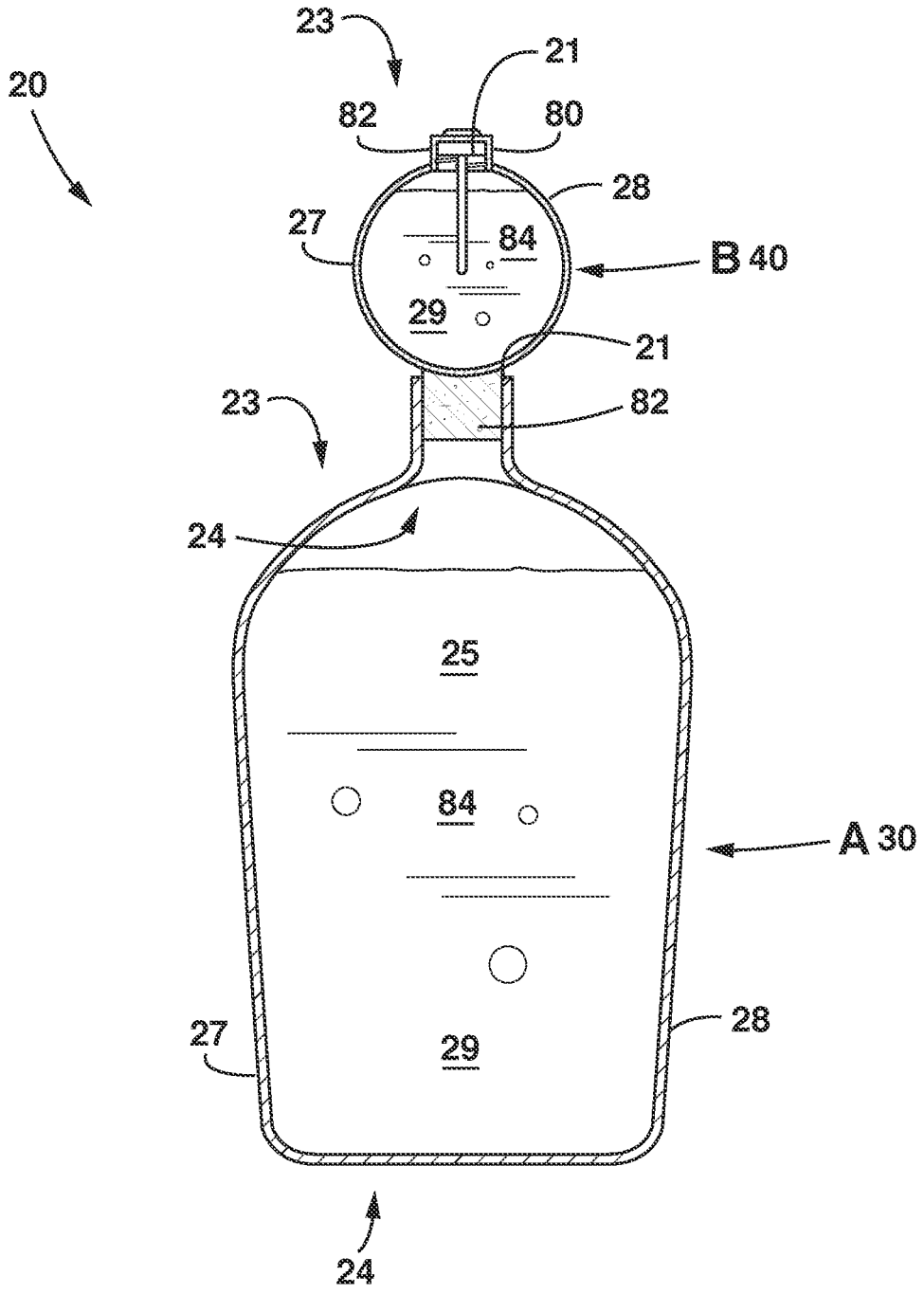
FIG. 5 is a front elevation view sectioned at the center plane of a second embodiment.

In particular FIG. 3 illustrates the grade marks 81 which can be incorporated in the bottle system 20 to provide for ease of use in measuring contents. Conventional and custom measuring systems can be used to functionally assist the consumer in dispensing and mixing contents 84 from a bottle system 20.

Figure 14:
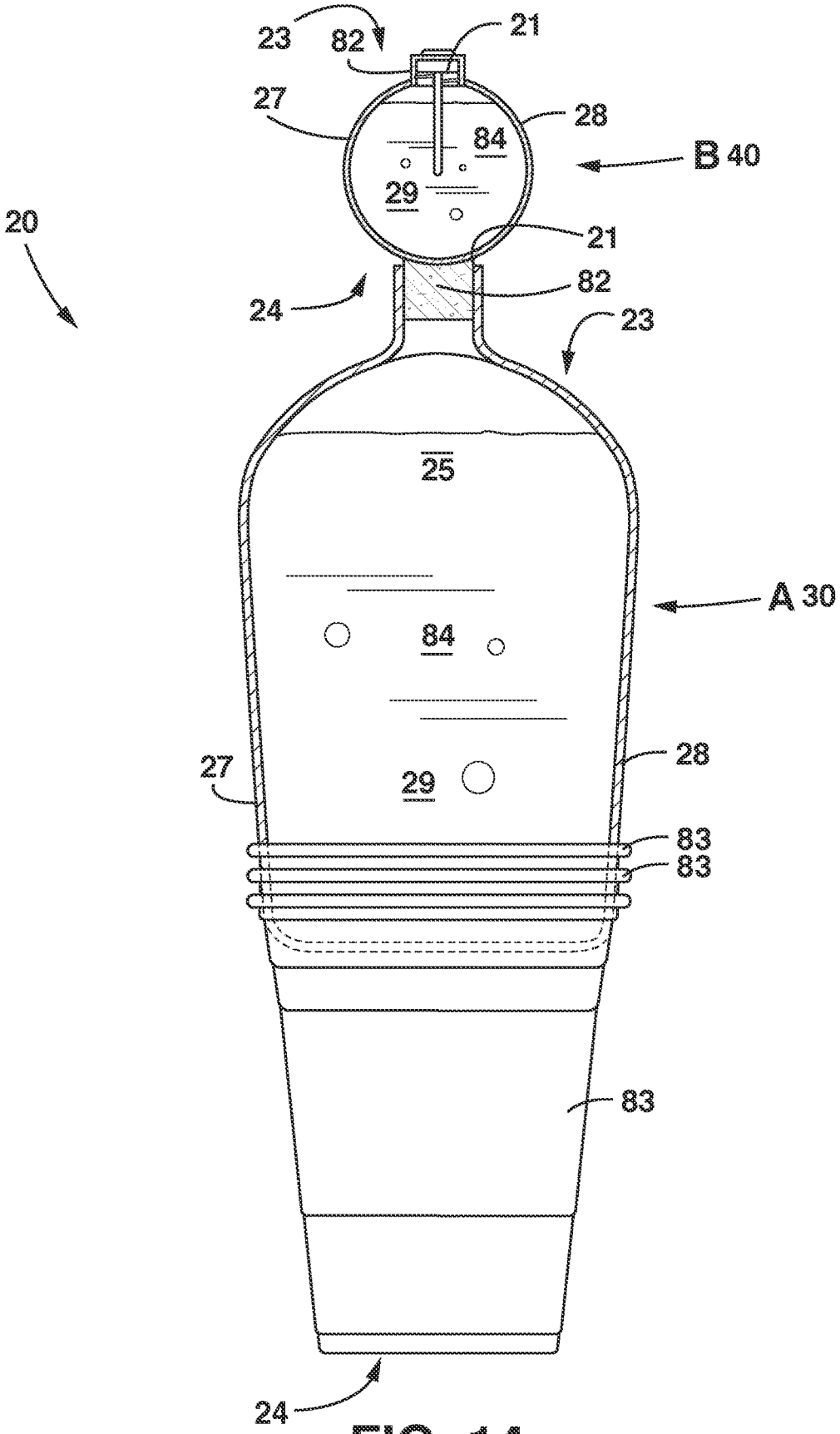
FIG. 14 is a front elevation view sectioned at the center plane of a eleventh embodiment.
Figure 15:
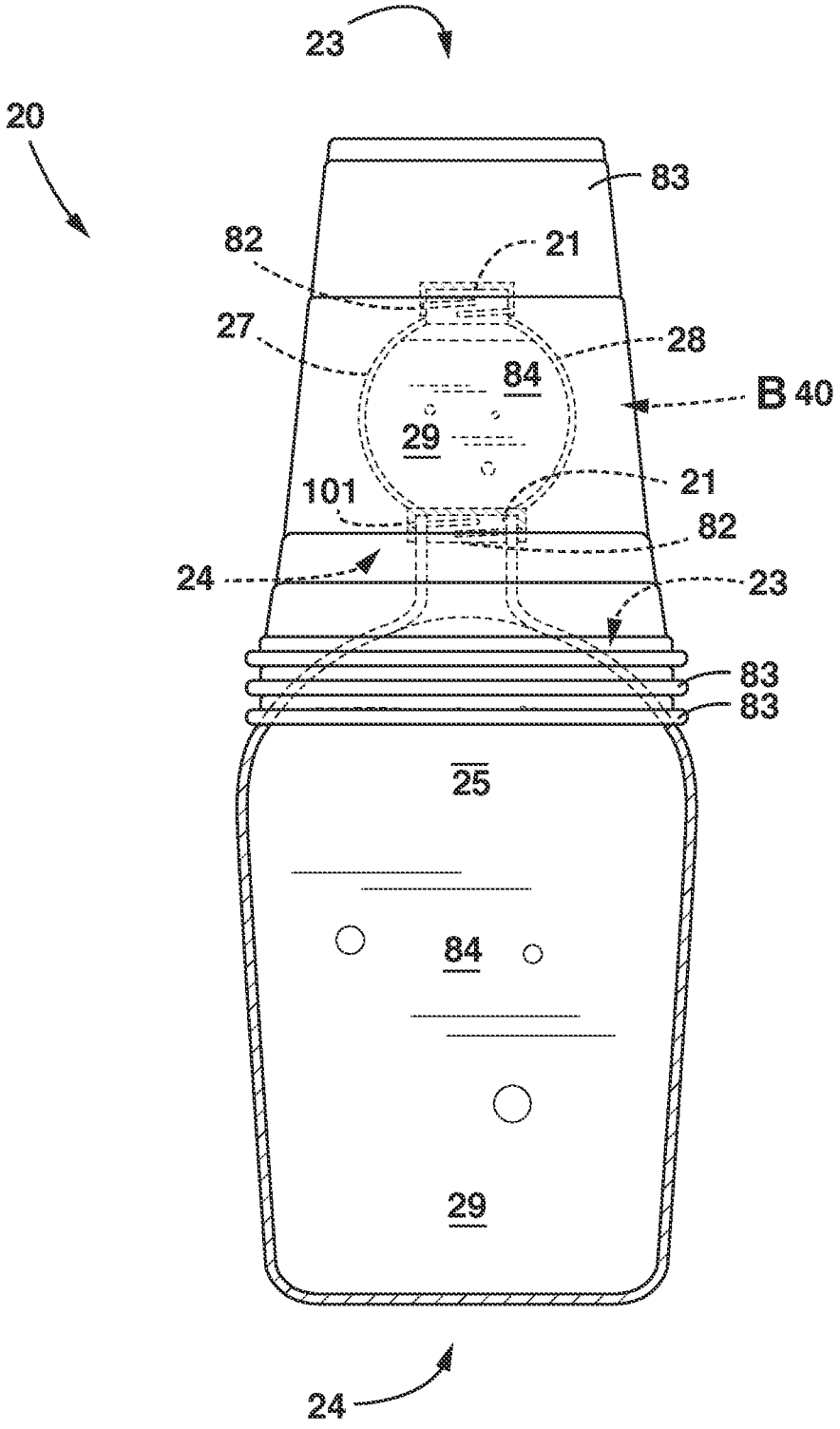
FIG. 15 is a front elevation view sectioned at the center plane of a second configuration of a eleventh embodiment.
Figure 16:
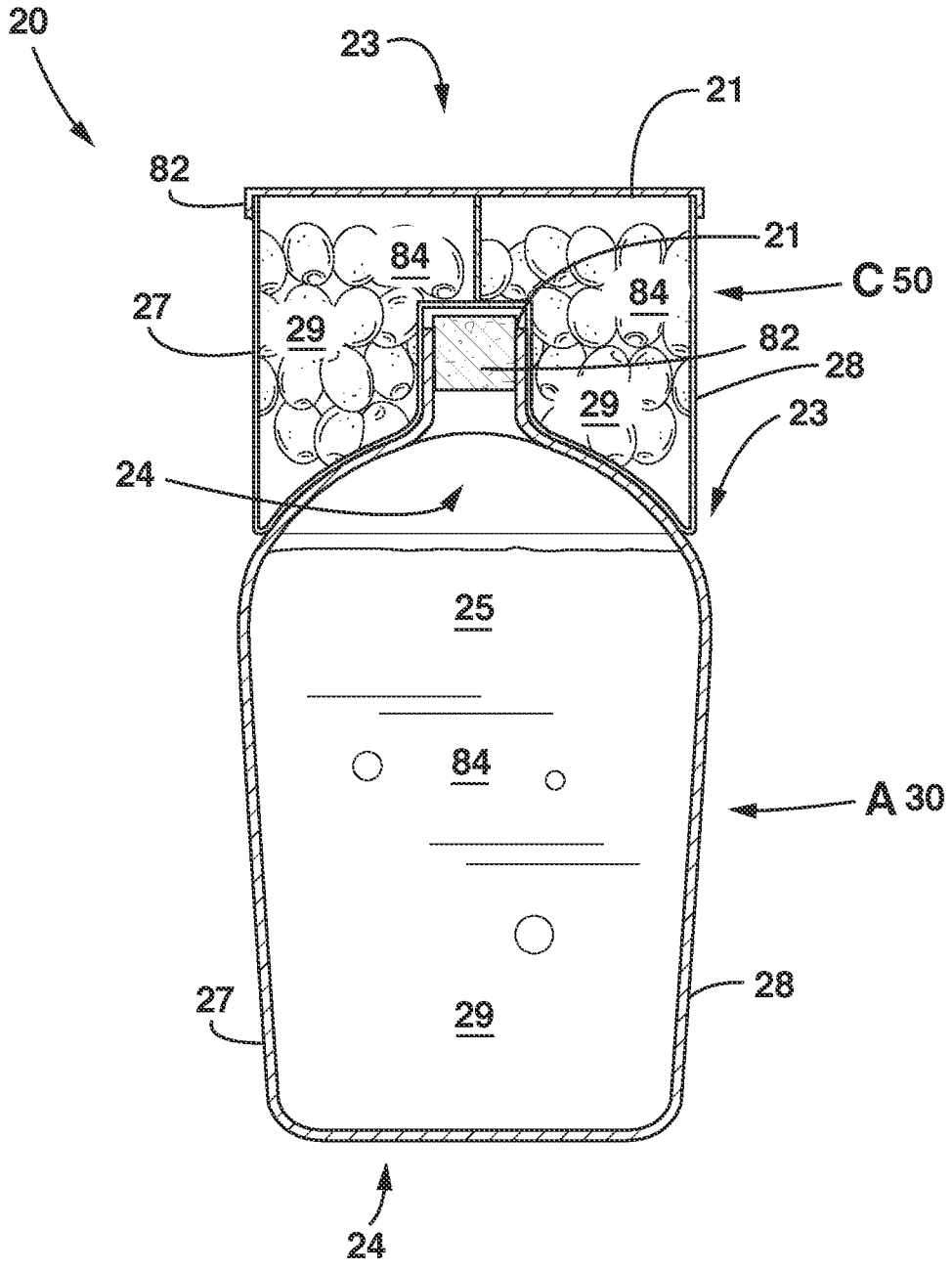
FIG. 16 is a front elevation view sectioned at the center plane of a twelfth embodiment.
Figure 17:
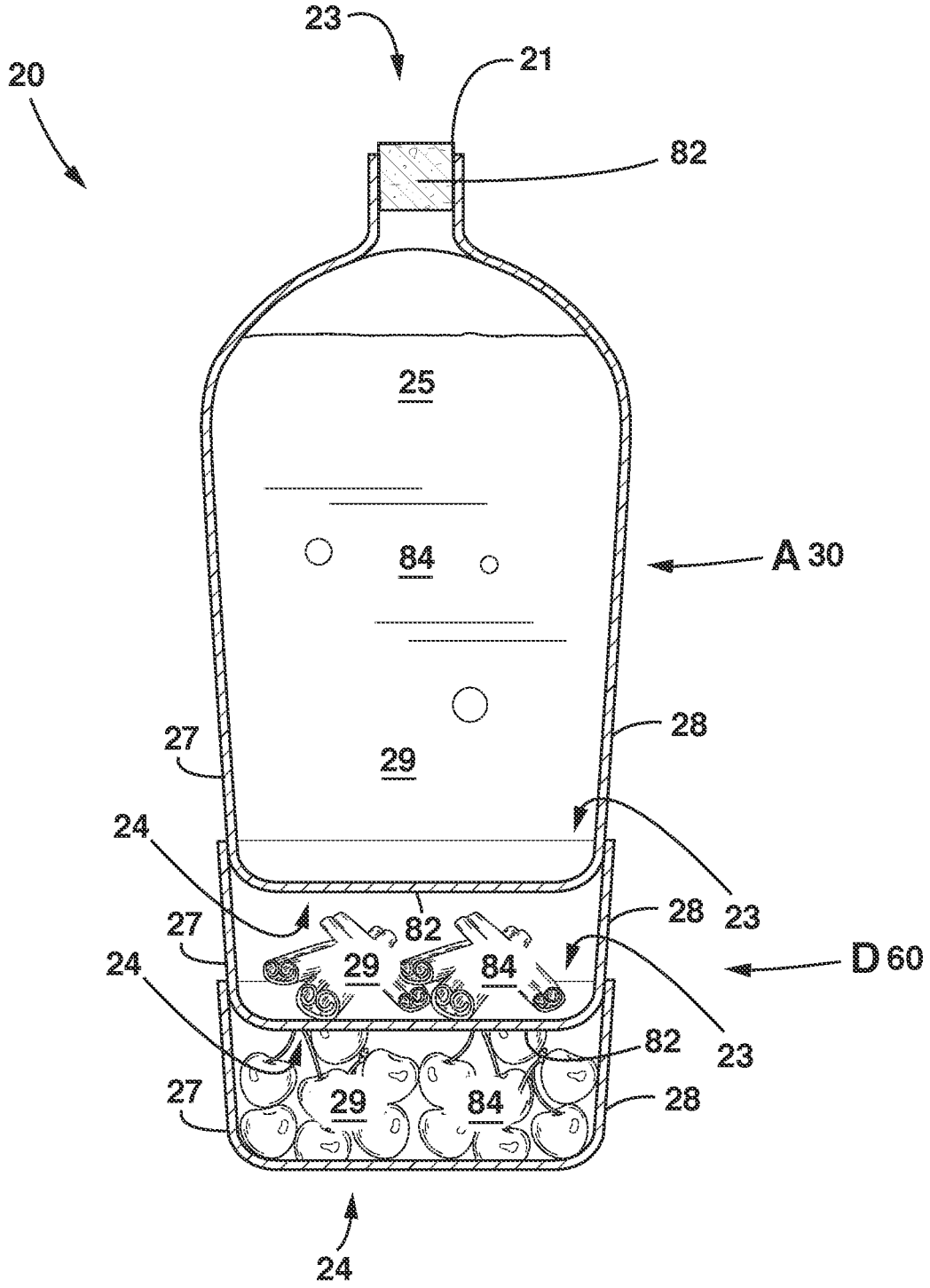
FIG. 17 is a front elevation view sectioned at the center plane of a thirteenth embodiment.
Figure 18:
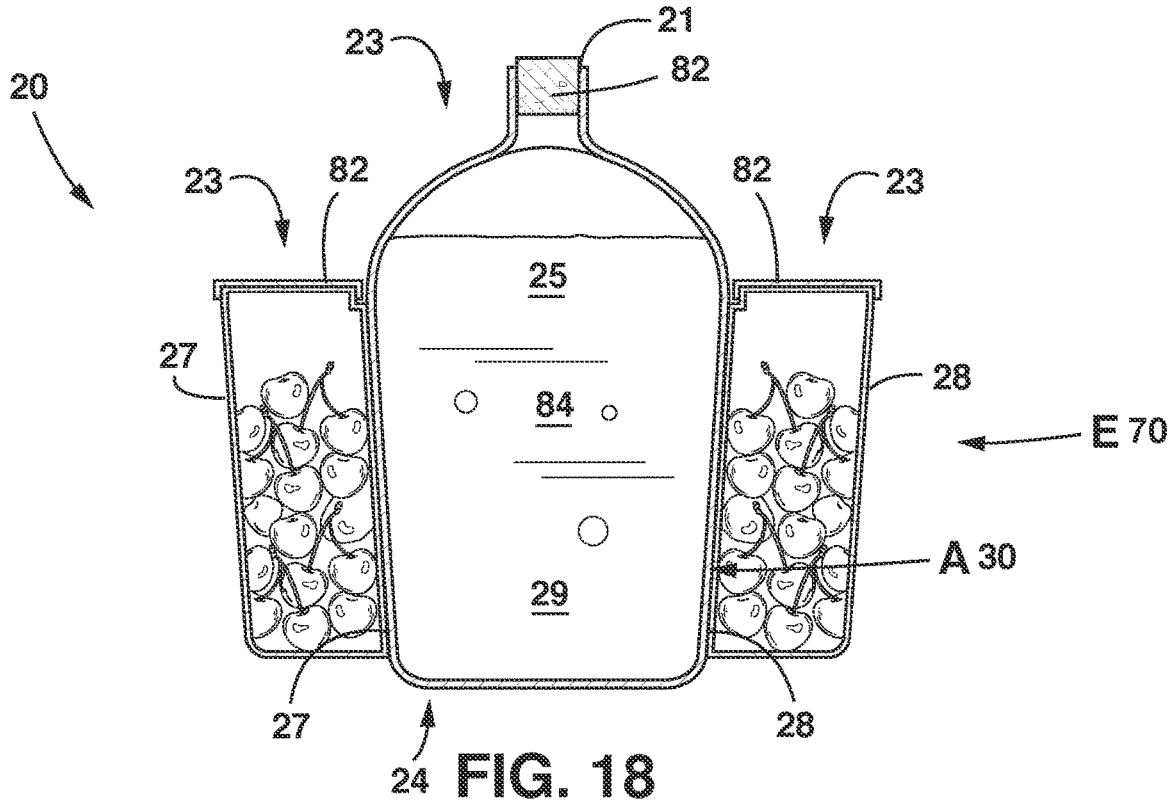
FIG. 18 is a front elevation view sectioned at the center plane of a fourteenth embodiment.
Figure 19:
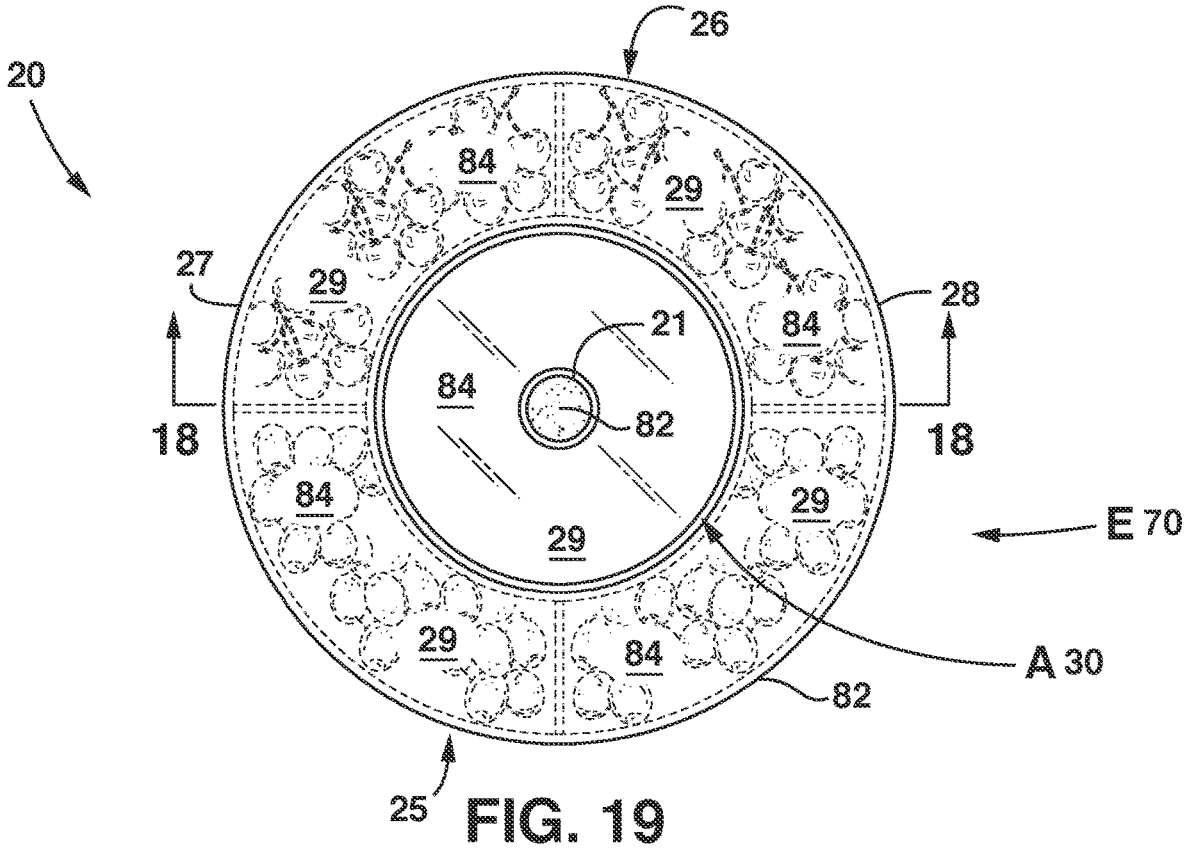
FIG. 19 is a top plan view sectioned at the center plane of a seventh embodiment.
Figure 20:
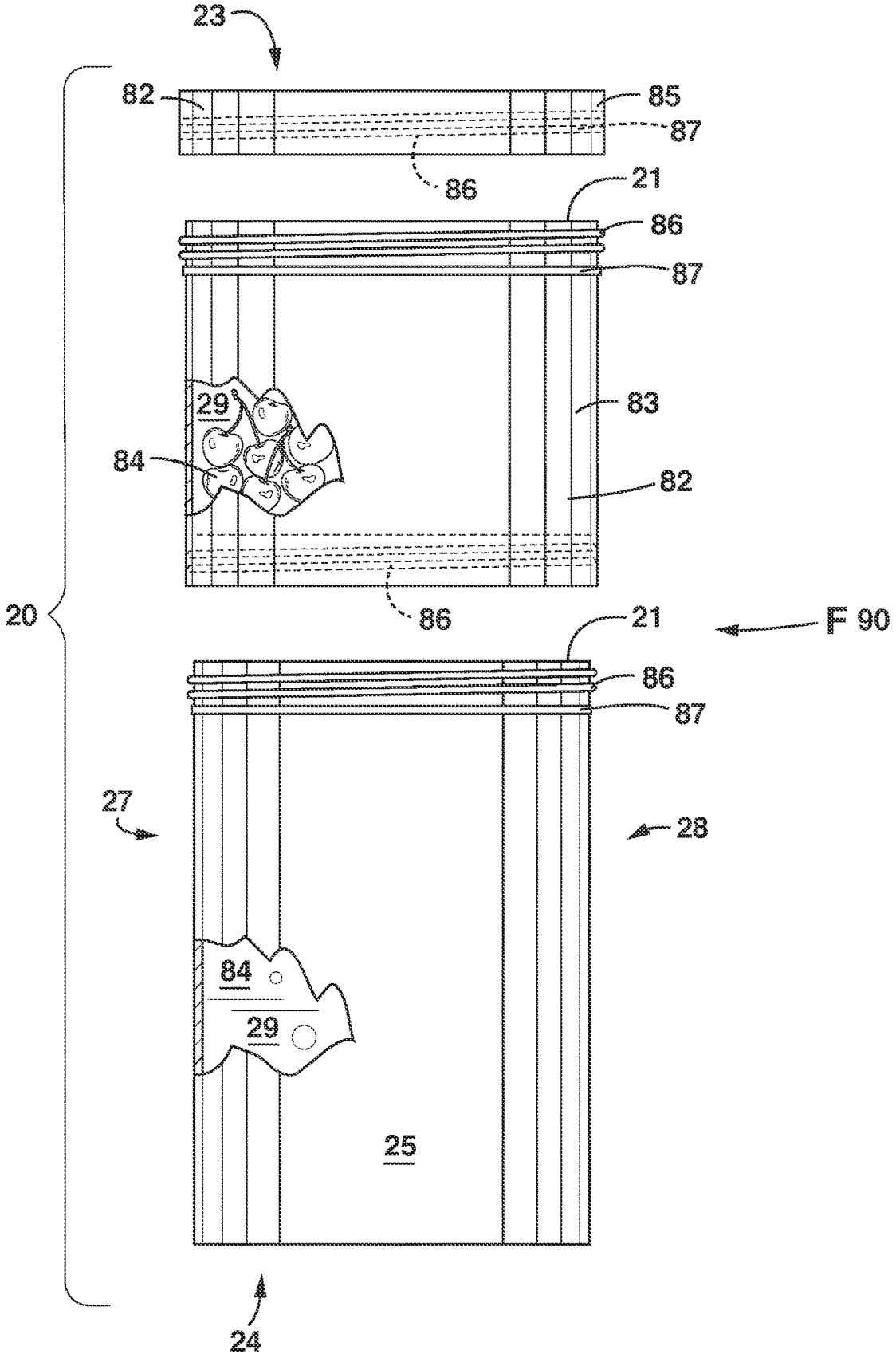
FIG. 20 is a front elevation view, with cut away sections, of a fifteenth embodiment.

Referring to FIG. 14 and FIG. 15, a bottle system 20 can have a vessel 83 such as a cup or drinking glass to name two examples. Vessel 83 can be stowed anywhere in a bottle system 20. In the drawings, as a way of example, a vessel 83 is stored in a top 23 and bottom 24 configuration. Referring to FIG. 16, the third volume-C 50 may have a bottom with a complimentary shape to fit entirely over the bottle neck of the first volume-A 30. In addition a forth volume may fit bellow the bottle, as shown in FIG. 17. In one embodiment, the additional volumes are configured to fit around and removably attach to the first volume, as shown in FIGS. 18-19, Referring to FIG. 20 a bottle system 20 can have a vessel 83 such as a cup with internal and external threads 86. Vessel 83 can have an inside 29 able to contain contents 84. Vessel 83 threads 86 can serve the purpose of affixing vessel 83 integrally with stowage means 20 as illustrated by sealable volume-F 90, of which one of its purposes is to contain contents 84 within its inside 29, making a compression seal at the gasket 87. In addition, vessel 83 may have a fitting 82 such as a cover 85 with internal threads 86 sealable at a gasket 87 located at the top 23 of vessel 83. Stowage means 20 represented by embodiment sealable volume-F 90 is a to go means of serving contents 84 which can later be mixed at home or another location away from a proprietary establishment.

Thus, herewith is provided a stowage means 20, such as a liquor bottle, bottle stopper or other volumes comprised of one or more contiguous compartments along with other paraphernalia such as dispensers 80, fittings 82 and vessels 83 in a unified package, stowage means 20, for conveniently selling, combining, storing and mixing contents together.

While the foregoing invention has been described in some detail for purposes of clarity and understanding, it will be appreciated by one skilled in the art, from a reading of the disclosure, that various changes in form and detail can be made without departing from the true scope of the invention.

What is claimed is:

1. A bottle system comprising:

a structure defining a first volume having an opening at a top thereof;

a structure defining a second volume having an opening at a top thereof and a means at a bottom of the second volume for removably attaching the second volume to the top of the first volume and a means for sealing the first volume, wherein the first volume is greater than the second volume, wherein the second volume includes a plurality of hollows, each with an opening therein; and a fitting for sealing the second volume.

2. The bottle system of claim 1, comprising a dispenser removably attached to the second volume.

3. The bottle system of claim 2, wherein the dispenser comprises one of a dropper, a pump, a pour spout, and a dropper plug.

4. The bottle system of claim 1, wherein the means for removably attaching the second volume to the first volume comprises a stopper.

5. The bottle system of claim 4, wherein the second volume comprises a skirt surrounding the stopper.

6. The bottle system of claim 5, wherein the skirt encloses the stopper entirely.

7. The bottle system of claim 5, wherein the skirt has a contact area with a flat surface sufficient to prevent the second volume from tipping over when placed on the flat surface.

8. The bottle system of claim 5, wherein the skirt has threads that mate with threads on the first volume.

9. The bottle system of claim 1, wherein a first of the plurality of hollows has an opening facing a first direction and a second of the plurality of hollows has an opening facing in a second direction different than the first direction.

10. The bottle system of claim 9, wherein the second volume has a footprint opposite each of the opening in the plurality of hollows, allowing access to only one of the openings in the plurality of hollows at a time.

11. The bottle system of claim 1, comprising a structure defining a third volume, the third volume configured to fit around and removably attach to the first volume.

12. The bottle system of claim 1, wherein the first volume has a bottle neck and wherein the second volume has a bottom end configured to cover the bottle neck.

13. The bottle system of claim 1, wherein the means at the bottom of the second volume for removably attaching the second volume to the top of the first volume comprises a threaded skirt therewith allowing the second volume to be screwed to the first volume.

14. The bottle system of claim 1, wherein the second volume has a cap with threads therein for sealing the second volume.

15. The bottle system of claim 1, wherein the means at the bottom of the second volume for removably attaching the second volume to the top of the first volume comprises a skirt.

* * * * *